United States Patent [19]

Ozechowski

[11] 3,995,535

[45] Dec. 7, 1976

[54] EXPANSIBLE CHAMBER DEVICE

[76] Inventor: Russell Ozechowski, 17-37 201 St., Bayside, N.Y. 11360

[22] Filed: May 23, 1975

[21] Appl. No.: 580,208

[52] U.S. Cl. ..... 92/60; 91/423; 92/6 R; 92/89; 123/18 R; 123/191 R; 123/193 CP

[51] Int. Cl.[2] ..... F01B 31/14

[58] Field of Search ..... 92/6 R, 6 D, 60, 89, 92/169; 91/423; 123/191 R, 18 R, 193 R, 193 CP

[56] References Cited

UNITED STATES PATENTS

| | | | |
|---|---|---|---|
| 147,519 | 2/1874 | Reilley | 92/89 X |
| 345,446 | 7/1886 | Powers | 92/89 |
| 1,266,252 | 5/1918 | Hadford | 92/89 X |
| 1,529,721 | 3/1925 | Ross | 92/169 X |
| 2,040,652 | 5/1936 | Gaty | 92/60 X |
| 2,387,114 | 10/1945 | Bonbright | 123/191 R |
| 3,254,837 | 6/1966 | Falconer | 92/6 R X |
| 3,908,512 | 9/1975 | Strubin | 92/89 X |

FOREIGN PATENTS OR APPLICATIONS

| | | | |
|---|---|---|---|
| 21,854 | 10/1907 | United Kingdom | 92/240 |

*Primary Examiner*—Martin P. Schwadron
*Assistant Examiner*—Abraham Hershkovitz
*Attorney, Agent, or Firm*—Imirie, Smiley & Linn

[57] ABSTRACT

An expansible chamber device in which a cylinder of preferably rectangular configuration supports a pair of opposing flaps pivotally attached to the corners of the cylinder. The flaps sealably and slidably engage the top surface of a piston disposed within the cylinder such that the surface area of the flaps together with the exposed surface area of the top surface of the piston between the flaps constitutes the effective working area of the device. This area is considerably greater than the area of the piston surface itself whereby overall efficiency of the chamber is increased.

9 Claims, 4 Drawing Figures

FIG. 1
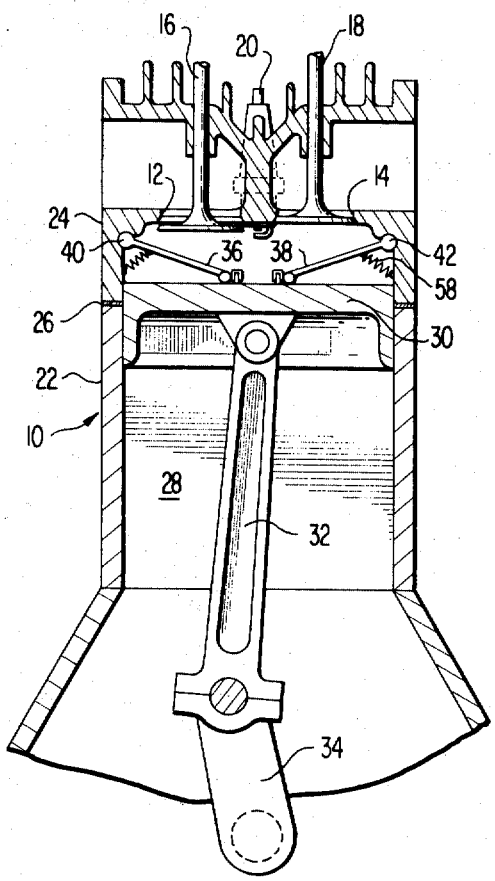
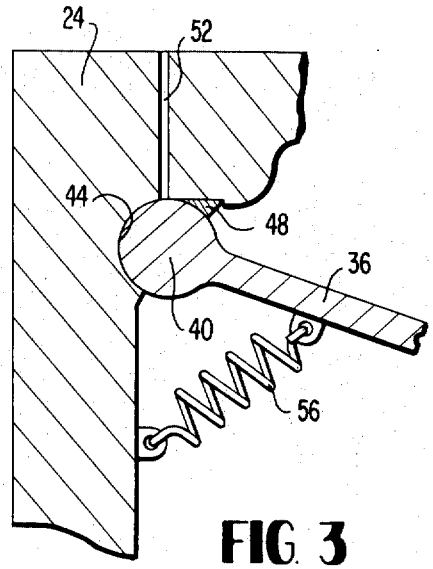
FIG. 3
FIG. 4
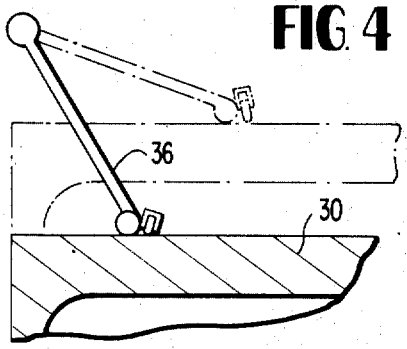
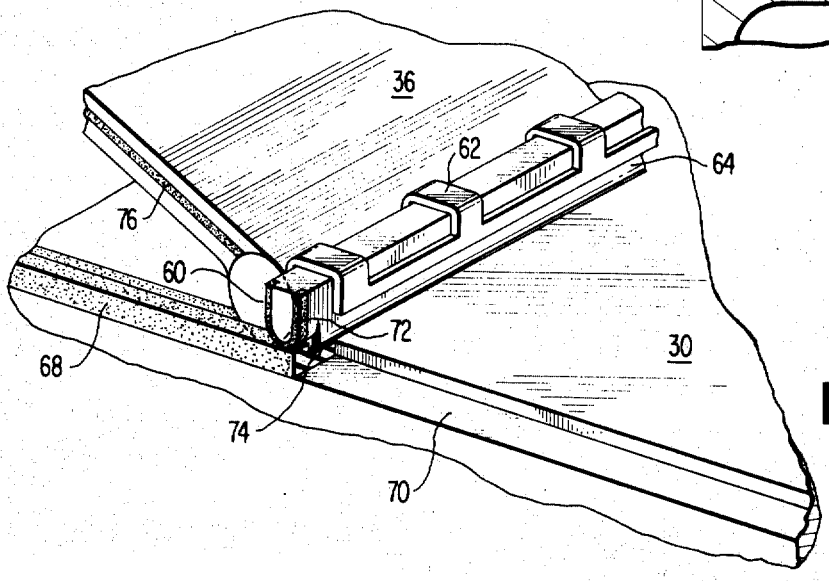
FIG. 2

EXPANSIBLE CHAMBER DEVICE

BACKGROUND OF THE INVENTION

1. Field of the Invention

The present invention relates to expansible chamber devices, and more particularly, to an expansible chamber device in which a pair of flaps cooperate with a reciprocating piston to increase the effective working area of the chamber and therefore the efficiency of the system.

2. Description of the Prior Art

Numerous attempts have been made in recent years to improve the overall operating efficiency of various expansible chamber devices. This is particularly true with regard to internal combustion engines wherein the operating efficiency of the engine is directly related to the rate of fuel consumption during use. Because of shortages in available fuel and increases in the cost of such fuel, the objectives of improving engine efficiency and reducing fuel consumption have been given high priority for some time.

Despite such priority treatment and the urgent need for a more efficient combustion chamber, conventional efficiency improving systems have been of limited success. This is true despite the recognition that greater efficiency can be obtained by concentrating as much of the expansive force as possible on the head of the working piston and to avoid dissipation of expansive force in directions that do not produce power. The prior art, as exemplified by U.S. Pat. Nos. 147,519; 345,446; 1,266,252; 1,529,721 and 2,804,496 is generally cognizant of systems which seek to increase efficiency by providing a greater effective working area against which expansive forces can act. None of these prior systems, however, can withstand the tremendous forces experienced during actual use especially in connection with an internal combustion engine. Further, many suffer from the disadvantage that they are extremely sensitive and must be critically balanced in order to prevent self-destruction. In those situations, knocking as produced by partial ignition or hot spots in the cylinder chamber would cause rapid deterioriation of the piston mechanism and damage to the engine.

Despite the known defects and disadvantages of available prior art units, there has not been heretofore available an expansive chamber device of simple and durable construction for increasing engine efficiency and decreasing fuel losses.

SUMMARY OF THE INVENTION

It is therefore an object of the present invention to improve the efficiency of an expansible chamber device by increasing the effective working area within the chamber.

A further object of the present invention is to construct an expansible chamber with a pair of flaps slidably cooperating with the top surface of a reciprocating piston to provide a greater area against which expansive forces of gases in the chamber can work.

The present invention is summarized as an expansible chamber device having a hollow body defining a smooth walled interior cavity, a reciprocating piston in the cavity and having a substantially flat top surface, and a flap assembly pivotally connected inside the cavity to the body and slidably engaging the top surface of the piston so as to form together with the closed end of the cavity and the exposed piston surface a sealed chamber.

This invention provides numerous advantages over conventional efficiency saving devices in that a considerably greater area is provided against which the gases can cause the production of useful work, that as the piston moves, the effective area continues to increase and becomes greater at the same time as the expanding gases deplete their stored energy so as to provide a smooth power stroke, and that construction and maintenance costs are substantially reduced because of the simplicity of the overall design.

Other objects and advantages of the present invention will become apparent from the following description of the preferred embodiment when taken in conjunction with the accompanying drawings.

BRIEF DESCRIPTION OF THE DRAWINGS

FIG. 1 is a sectional view showing an internal combustion engine having an expansible chamber device according to the present invention;

FIG. 2 is a perspective view of a detail of the assembly of FIG. 1;

FIG. 3 is a sectional view of the hinge detail of the assembly of FIG. 1; and FIG. 4 is a diagrammatic view showing the flaps of the present invention in two different positions.

DESCRIPTION OF THE PREFERRED EMBODIMENT

The present invention is adapted to be utilized in connection with any type of engine or pump wherein an expansible chamber having greater efficiency is desired. As shown in FIG. 1, the invention is incorporated in an internal combustion engine 10 having inlet and outlet ports 12 and 14, respectively, controlled by valves 16 and 18. A spark plug 20 is also mounted adjacent valves 16 and 18 to ignite the charge.

Engine 10 has a main body formed by a block 22 and a head portion 24 joined together by a suitable head gasket 26. Bolts or other suitable means (not shown) may be utilized to secure the head 24 to the block 22 in a conventional manner. Head 24 is closed off at the upper portion for supporting valves 16 and 18 as well as spark plug 20 and defines an interior cavity 28. The side walls of cavity 28 are formed of planar surfaces so that the cavity has rectangular, smooth-walled configuration.

Received within cavity 28 is a rectangular piston 30 connected by a connecting rod 32 to a crankshaft 34. Because of the unique structure of the present assembly, conventional valves about the piston 30 are not necessary.

Referring now to FIGS. 1–3, a pair of flaps 36 and 38 are pivotally connected to the upper corners of the cavity by hinges 40 and 42, respectively. Flaps 36 and 38 are preferably of a rectangular configuration and hinges 40 and 42 may be either integrally formed or attached as by welding. As shown in FIG. 3, the hinges are received in a conforming socket 44 and 46 and a wedge-shaped elongated seal element 48, 50, is positioned adjacent the hinge such that the expansible gases will not be permitted to escape. Oil channels 52 and 54 may also be provided to lubricate the hinge during operation. A pair of tension springs 56 and 58 are connected by appropriate means such as eyelets between the flaps 36 and 38, respectively, and the side walls of the head 24. These springs assure that the flaps will be maintained in firm engagement with the top surface of piston 30 and are not necessary for a two-stroke engine. Springs 56 and 58 can also replaced by any suitable biasing means such as a shock absorber or connecting rod synchronized with piston movement.

It should be understood, of course, that appropriate cooling and lubricating channels may be provided in a conventional manner. These as well as other conventional details have not been illustrated or described merely for the sake of brevity. FIG. 2 illustrates a detail of the distal end of flap 36 although it should be appreciated that the distal end of flap 38 is similarly constructed. On the lower end of flap 36 there is formed an elongated roller 60 to provide a durable means of allowing flap 36 to slidably engage the top surface of piston 30. Rigidly attached to the front of the flap 36 adjacent roller 60 is a retaining assembly 62 in the form of an inverted, generally U-shaped retaining clip. Retainer 62 is attached, as by welding, to the end of flap 36 and serves to hold in position an elongated, generally rectangular seal member 64. The bottom edge of seal 64 is rounded about a longitudinal axis so as to maintain constant contact with the top surface of piston 30. The configuration of retainer 62 and seal member 64 is such that the seal may be allowed to move up and down with respect to the flap 36 as the flap pivots. This is illustrated diagrammatically in FIG. 4 which shows the flap 36 in two different positions. In its lowermost position the seal element 64 is moved upwardly to the top of the retainer 62, while the seal 64 moves to its lowermost position within the retainer as the flap pivots upwardly.

A seal element 68 having a generally L-shaped configuration is disposed in a confirming groove or channel 70 along the top corner of each side of the piston 30. This seal cooperates with the end of the seal element 64 as well as a pair of small, U-shaped seal members 72 and 74 to complete the seal at the ends of the flap.

Flaps 36 and 38, together with the closed upper end of the interior cavity 28 and the exposed surface of piston 30 form a sealed combustion chamber. Additional elongated seals 76 along both sides of flaps 36 and 38 may also be provided to cooperate with the interior side walls of the cavity to enhance the overall seal of the chamber. As can be appreciated from FIG. 1, as the piston 30 reciprocates, the effective working area for the expanding gases will be the area of both of the flaps 36 and 38 as well as the area of the exposed part of the piston between the flap ends. Thus, the present invention provides a much greater working area against which the expanding gases can produce useful work or energy.

Since the effective working area of the present chamber is increased dramatically, improved efficiency results and greater fuel economy can be expected. In addition, becuase of the unique nature of the rectangular configuration of the combustion chamber and the disposition of flaps 36 and 38 within head 34, removal of the head exposes both the flap assemblies and the valve assemblies for easy maintenance.

It should be understood, of course, that while the combustion chamber has been described as being rectangular, it can also be square or any other desired configuration.

Inasmuch as the present invention is subject to many variations, modification and changes in detail, it is intended that all matter contained in the foregoing description or shown in the accompanying drawing shall be interpreted as illustrative and not in a limiting sense.

What is claimed is:

1. An expansible chamber device, comprising a hollow body defining a smooth-walled interior cavity having side walls and a closed end; a piston reciprocably disposed in said cavity slidably engaging said side walls and having a substantially flat top surface; flap means pivotally connected to said body only said flap means being positioned inside said cavity adjacent said closed end and slidably engaging the top surface of said piston; first means sealing said flap means with respect to said body; second means sealing said flap means with respect to the top surface of said piston; said flap means, said top surface of said piston, and said closed end of said cavity cooperating to define a closed, expansible chamber; supply means for communicating a working medium to said expansible chamber; said flap means comprising first and second flaps each pivotally connected at a proximal end to said body on respective opposite sides of said interior cavity with the distal ends thereof in sliding engagement with the top surface of said piston such that said flaps continuously open as the piston moves away from the closed end of said body to expose a progressively greater area of the top surface of said piston to said working medium while the surface area of said flaps remains constant independent of piston position; the total exposed surface area of the flaps and the piston against which work is performed, by said medium increasing working as said piston moves away from the closed end of said body.

2. The invention as recited in claim 1 wherein said interior cavity is defined by rectangularly disposed planar side wall surfaces; and wherein each of said flaps comprise a substantially rectangular flat plate.

3. The invention as recited in claim 2 wherein each of said flaps further include a roller on the distal end thereof in engagement with the top surface of said piston.

4. The invention as recited in claim 3 wherein said second sealing means comprises elongated seal members carried on the distal end of each of said first and second flaps and longitudinally engaging the top surface of said piston, said seal members having a generally rectangular cross-section and being linearly movable along the distal side surface of its associated flap.

5. The invention as recited in claim 4 wherein one of the shorter longitudinal sides of each seal member is rounded about a longitudinal axis for engaging the top surface of said piston as the same is reciprocated.

6. The invention as recited in claim 5 wherein said second sealing means further includes means sealing the ends of each of said seal members with the walls of said interior cavity and the edges of said piston.

7. The invention as recited in claim 1 wherein said first sealing means comprises wedge-shaped seal elements disposed between the closed end of said body and a rounded proximal end of each flap.

8. The invention as recited in claim 1 further including means biasing said flap means against the top surface of said piston.

9. The invention as recited in claim 1 wherein said body comprises a block portion and a separable head portion including said closed end; and wherein said flap means is attached to said head portion.

* * * * *